US005697121A

United States Patent [19]

Early

[11] Patent Number: 5,697,121

[45] Date of Patent: Dec. 16, 1997

[54] RAILROAD CAR HATCH COVER LOCK

[75] Inventor: Stephen R. Early, Olathe, Kans.

[73] Assignee: Aero Transportation Products, Inc., Independence, Mo.

[21] Appl. No.: 549,937

[22] Filed: Oct. 30, 1995

[51] Int. Cl.[6] ..... E05D 15/50

[52] U.S. Cl. ..... 16/231; 16/380; 16/366; 49/193; 292/DIG. 17; 105/377.01; 105/377.11

[58] Field of Search ..... 16/231, 229, 230, 16/232, 256, 257, 258, 259, 380, 386, 366; 292/DIG. 17; 49/193; 105/377.01, 377.03, 377.02, 377.05, 377.11

[56] References Cited

U.S. PATENT DOCUMENTS

| | | | |
|---|---|---|---|
| 1,160,835 | 11/1915 | Brown | 105/377.11 |
| 2,357,397 | 9/1944 | Fuller | 49/193 |
| 3,848,912 | 11/1974 | Jensen et al. . | |
| 4,000,703 | 1/1977 | Halliar | 105/377.11 |
| 4,613,174 | 9/1986 | Berg et al. | 16/231 |
| 4,985,962 | 1/1991 | Weber | 16/231 |
| 5,311,824 | 5/1994 | Sauer et al. | 49/193 |

OTHER PUBLICATIONS

IRECO Hatch Cover Lock, #30149, 2 pages.

IRECO Combination Hinge and Lock, #30169, 2 pages.

IRECO "Tu-Way" Hatch Cover Lock & Hinge with Retainer Hook, #30311 and #30322, 3 pages.

*Primary Examiner*—Chuck Y. Mah

*Attorney, Agent, or Firm*—Chase & Yakimo

[57] ABSTRACT

A double hinge locking system mounts and secures a series of two-way opening covers or similar members. Each hinge/lock component of the system provides a combination hinge pivot and associated lock that operate on a common axis, and includes a locking device in which fixed and rotary locking parts are presented by fixed and movable saddles coaxial with the hinge axis and relatively rotatable about such axis between locked and unlocked conditions. An interlock mechanism interconnects locking devices on opposite sides of the hinged member to prevent double unlocking. Additionally, a passive safety lock is provided by the cooperating saddles to prevent separation of the member from its mounts in the event that double unlocking inadvertently occurs.

13 Claims, 5 Drawing Sheets

22
35
82
84
48
104
220
70
68
78
58
80
92
94
102
53
98
86
60
76
7.
6.
A
9.
8.
64
88
90
100
112
74

RAILROAD CAR HATCH COVER LOCK

BACKGROUND OF THE INVENTION

This invention relates to improvements in locking systems for two-way opening covers and similar hinged members and, in particular, to such a locking system that provides a hinging action and a locking function on a common axis and, additionally, provides an active interlock and a passive safety lock to prevent separation of the member from both of its hinges.

Railway hopper cars have been employed for years to transport particulate and granular materials such as grain. Typically, a car is loaded or unloaded through the use of overhead chutes that extend through one or more hatches in the top of the car that have been opened for loading or unloading purposes. One type of hopper car in widespread use presents a continuous trough extending substantially the length of the car which communicates with the top of the car and is closed during transport by a series of longitudinally extending, end-to-end hatch covers. One means of securing the hatch covers during transport is to employ battens located at the abutting ends of the covers that are locked in place to hold the covers closed. Another means of securing the hatch covers is battenless and provides an effective seal at the abutting ends of the hatch covers without the use of battens, and is described in U.S. Pat. No. 5,355,808 of Stephen R. Early, owned by the assignee herein.

In a railroad car of the type just described, it is preferred that the hatch covers be of the two-way opening type, i.e., provided with hinges and locks along both sides of the covers so that they may be pivoted about either side to the open position by releasing the locks on the opposite side. This facilitates access to the car for loading or unloading from either side of the trough. However, dual hinges and locks add to the complexity of the cover system and, if improperly used, present a serious hazard as a heavy hatch cover could be accidentally separated from its hinges if both sides are inadvertently unlocked.

It may be appreciated that the same problem of accidental separation is presented with two-way battens and secondary cover members that may be employed on railroad cars, as well as other applications in which two-way opening cover members and the like are employed. Therefore, although the present invention is described herein in the context of a railroad car environment, it will be appreciated that its use in other applications is also contemplated.

SUMMARY OF THE INVENTION

It is, therefore, the primary object of the present invention to provide a double hinge locking system for a two-way opening cover or similar member in which each hinge/lock component of the system provides a combination hinge pivot and associated lock that operate on a common axis.

As a corollary to the foregoing object, it is an important aim of this invention to provide such a locking system in which separation of the hinged member from its mounts is prevented by an interlock or a passive safety lock, or both as desired.

Another important object of the invention is to provide such a system in which each locking device thereof has fixed and rotary locking parts coaxial with a hinge axis provided by the device, the rotary part being movable between locked and unlocked positions relative to the fixed part to release the member in the unlocked position and, when locked, permit opening from the other side by rotation of the member about the hinge axis of the locked device.

Another important object of the invention is to provide such a system in which the fixed and rotary locking parts of each locking device are presented by fixed and movable saddles coaxial with the hinge axis and relatively rotatable about such axis between locked and unlocked conditions.

Still another object is to provide a double hinge locking system for a two-way opening cover or similar member in which only one combination hinge and locking device may be required for each hinge axis of an individual member, thereby minimizing the number of such devices needed in a complete system utilized with a plurality of two-way opening members.

Yet another object is to provide a double hinge locking system as aforesaid having an interlock mechanism interconnecting locking devices on opposite sides of the hinged member, and arranged to prevent double unlocking so that only one device can be unlocked at a given time.

A further and important object of the invention is to provide a hinge and locking device in which cooperating locking parts or saddles are configured to interfere with one another if a supported member is swung about the hinge axis of the device, whereby to provide a passive safety lock precluding separation of the member from its mounts under such circumstances.

DETAILED DESCRIPTION

Figure 1:
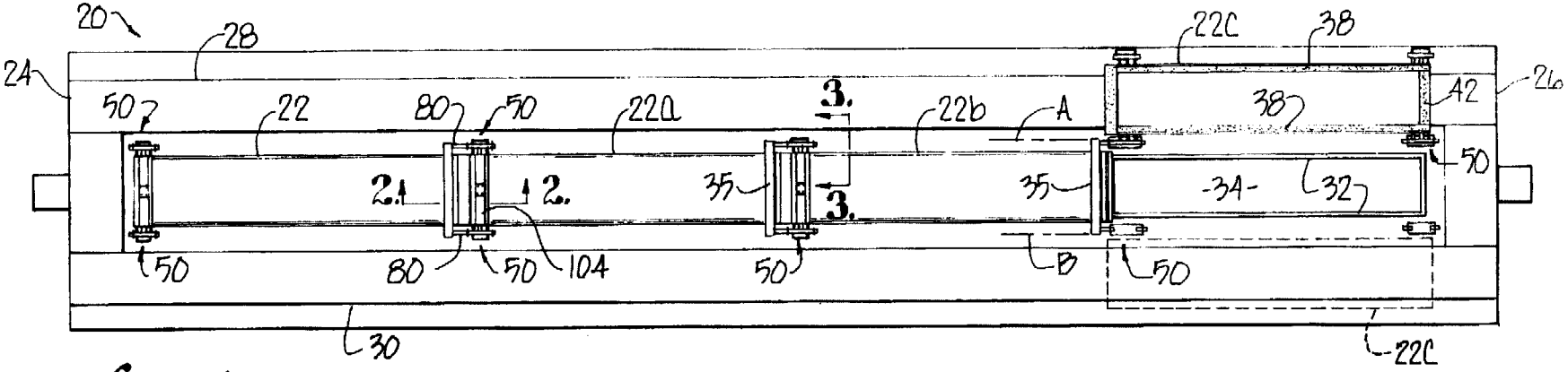
FIG. 1 is a plan view of a railway hopper car equipped with the double hinge locking system of the present invention, one of the hatch covers being shown open in its alternative positions as illustrated by full and broken lines respectively.
Figure 3:
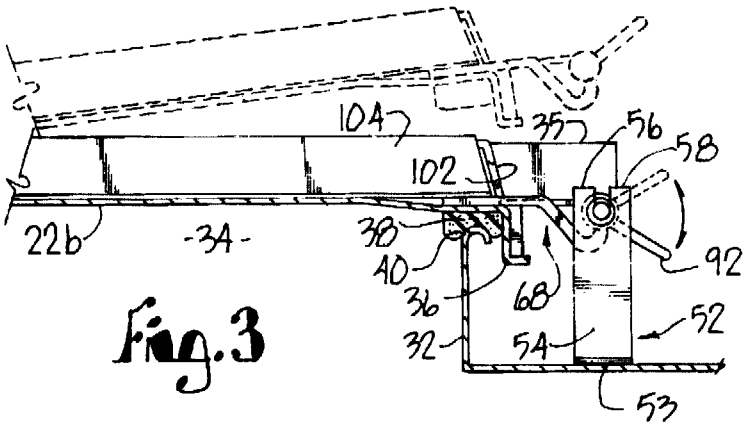
FIG. 3 is a enlarged, fragmentary, vertical sectional view taken along line 3—3 of FIG. 1, the hatch cover being shown in broken lines in a partially open condition.
Figure 2:
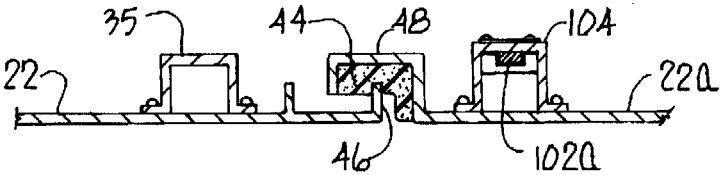
FIG. 2 is a enlarged, fragmentary, vertical cross-sectional view taken along line 2—2 of FIG. 1.

Referring initially to FIGS. 1–3, a railroad car 20 is provided with a series of four, end-to-end hatch covers 22, 22*a*, 22*b* and 22*c* extending longitudinally from essentially the left end 24 to the right end 26 of the car. The right-most hatch cover 22*c* in FIG. 1 is shown in full lines in its open position overlying the top of a running board 28 that extends the length of the car 20. As each of the covers 22, 22*a*, 22*b* and 22*c* is of the two-way opening type, the other open position of cover 22*c* is shown in broken lines overlying the top of a second running board 30 on the opposite side of the car 20 that extends in parallelism with running board 28. As is conventional, the running boards 28 and 30 are provided for attending personnel during loading and unloading of the car 20 when it is necessary to open and close the hatch covers.

As may be appreciated from a comparison of FIGS. 1 and 3, the car 20 has a typical hopper car configuration and is provided with two parallel, longitudinally extending walls 32 spaced equidistant from the transverse center of the car which provide a coaming along the top of the car 20 on which the covers 22–22*c* are disposed. The coaming 32 presents a hatch that defines a longitudinal opening or trough 34 which communicates with the storage compartment of the car therebelow (not shown).

All of the hatch covers 22, 22*a*, 22*b* and 22*c* are of the same size and are of rectangular configuration with their adjacent ends overlapping as no battens are utilized. Each cover is composed of a flat sheet of aluminum reinforced by a transverse stiffener bar 35 adjacent one end thereof. The aluminum sheet has downturned longitudinal margins 36, one such margin 36 of cover 22*b* being shown in detail in FIG. 3. A longitudinally extending gasket strip 38 is located at each margin 36 on the underside of the cover for the purpose of contacting the upper edges of the sidewalls (coaming) 32 which are bent over to provide a smooth arcuate surface 40. It will be appreciated that the endmost covers 22 and 22*c* also have gasket strips associated with their outer ends (as at 42 in FIG. 1 for cover 22*c*) which seal against the end walls of the coaming. Seals at the overlapping ends of adjacent covers are illustrated in FIG. 2 for covers 22 and 22*a* where it may be seen that a sealing strip 44 is compressed between an upturned sealing edge 46 on cover 22 and a projecting lip 48 on cover 22*a*. Accordingly, the hatch is effectively sealed by the covers 22–22*c* when they are closed and secured by the double hinge locking system of the present invention to be discussed.

Five pairs of combination hinge and locking devices are employed in the disclosed embodiment for controlling the two-way opening and closing of the four hatch covers 22–22*c*. Each such device is generally designated 50 and provides both a hinge axis A or B (FIG. 1) and a lock for securing the associated cover. Axes A and B are parallel with each other and are located adjacent the respective longitudinal edges of the series of covers 22–22*c*. For example, as seen in FIG. 1, cover 22*c* is shown in full lines swung to its open position about axis A; the broken line illustration of cover 22*c* is its open position upon rotation about axis B until the cover rests against running board 30.

The locking devices 50 on each side of the series of covers are in axial alignment, i.e., either hinge axis A or B. Two devices 50 on axes A and B, respectively, at the left end of cover 22 (as viewed in FIG. 1) control the opening and securing of cover 22. Likewise, the two devices 50 at the left end of each of the covers 22*a* and 22*b* control the respective covers 22*a* and 22*b*. Four locking devices 50 are utilized for end cover 22*c* as will be explained.

Referring particularly to FIGS. 3–9 and 14–18, each device 50 is supported on a U-shaped metal mount 52 having a base 53 secured to the top surface of the car 20 between the running board 28 or 30 and the coaming 32. Each mount 52 presents a pair of upstanding legs 54 spaced along axis A or B, each leg 54 having a bifurcated upper end provided by a vertical slot or opening 56 best seen in FIGS. 3 and 16–18. The free upper end of each leg 54, therefore, presents a pair of spaced ears 58 between which the opening 56 extends downwardly to a channel-shaped saddle element 60 welded to leg 54. It may be appreciated, therefore, that a pair of saddle elements 60 are fixed to the upper ends of the legs 54 of each mount 52 in alignment with either axis A or B.

Figures 4, 5, 6, 7:
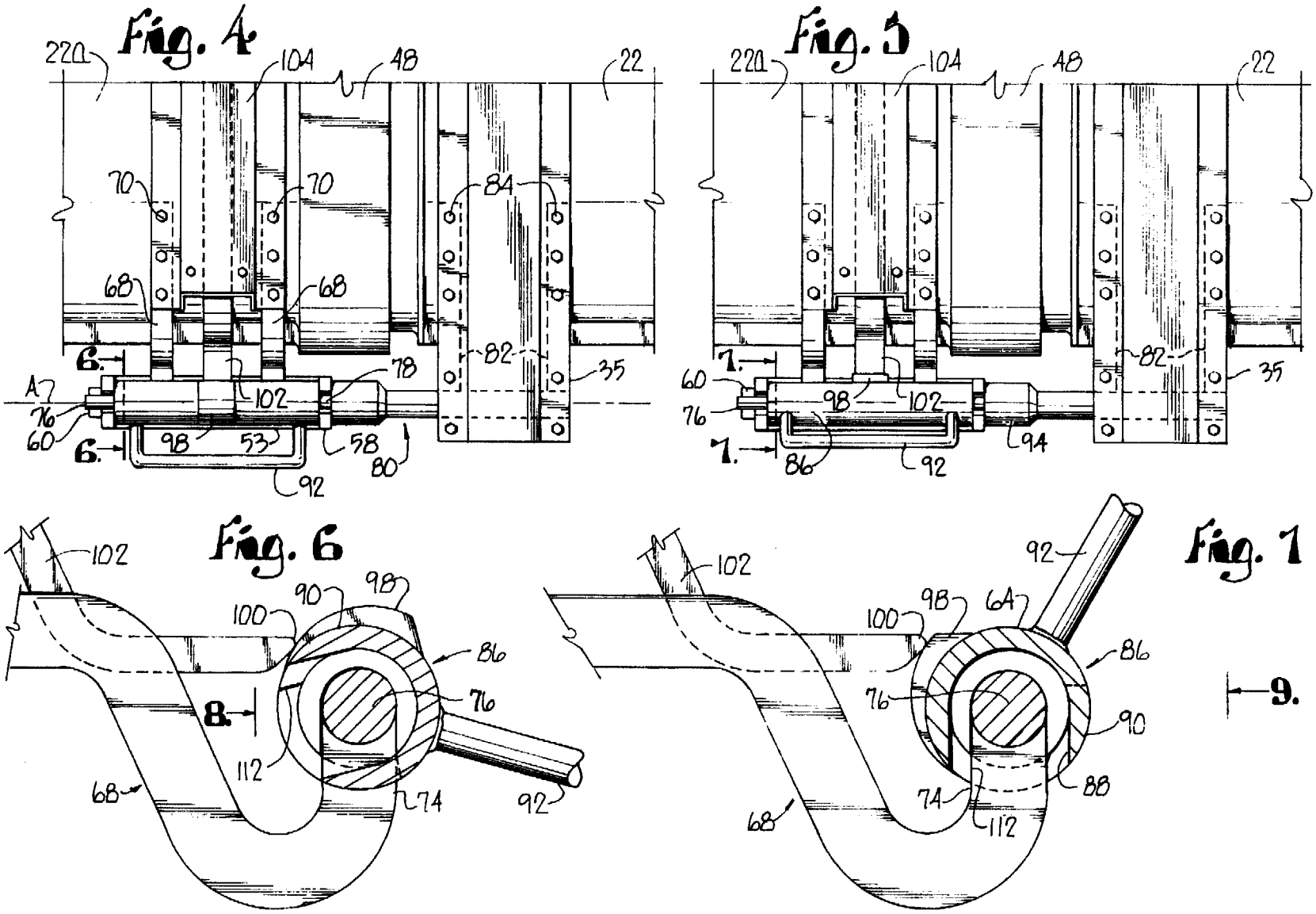
FIG. 4 is an enlarged, fragmentary, plan view of one of the locking devices (locked condition) in association with two adjacent hatch covers.
FIG. 5 is a view similar to FIG. 4 but showing the device unlocked.
FIG. 6 is a greatly enlarged, fragmentary, vertical sectional view taken along line 6—6 of FIG. 4.
FIG. 7 is a greatly enlarged, fragmentary, vertical sectional view taken along line 7—7 of FIG. 5.
Figure 8:
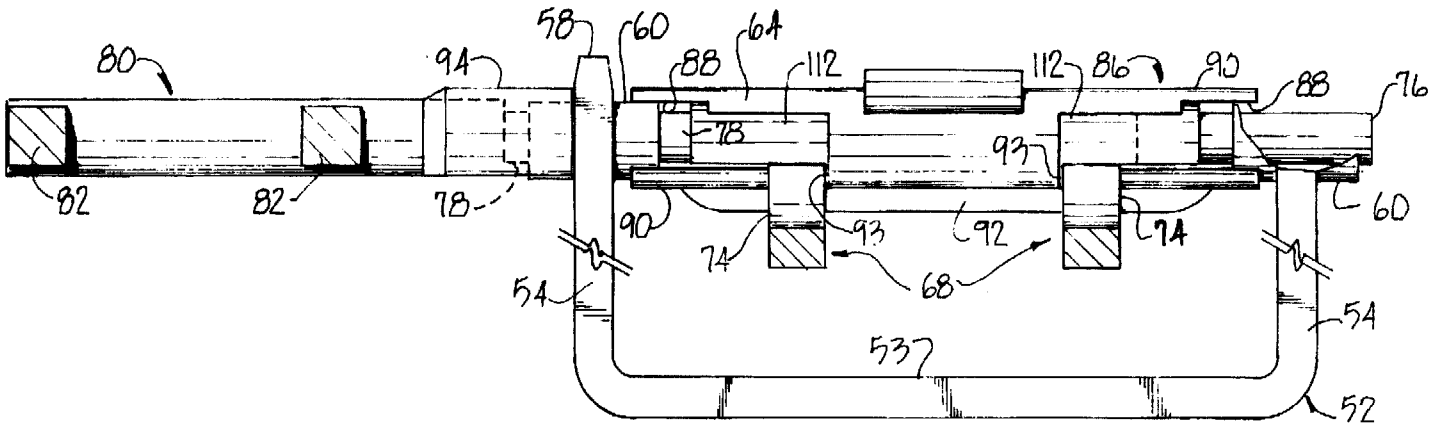
FIG. 8 is a vertical sectional view taken along line 8—8 of FIG. 6, parts being broken away to reveal details of construction.
Figure 9:
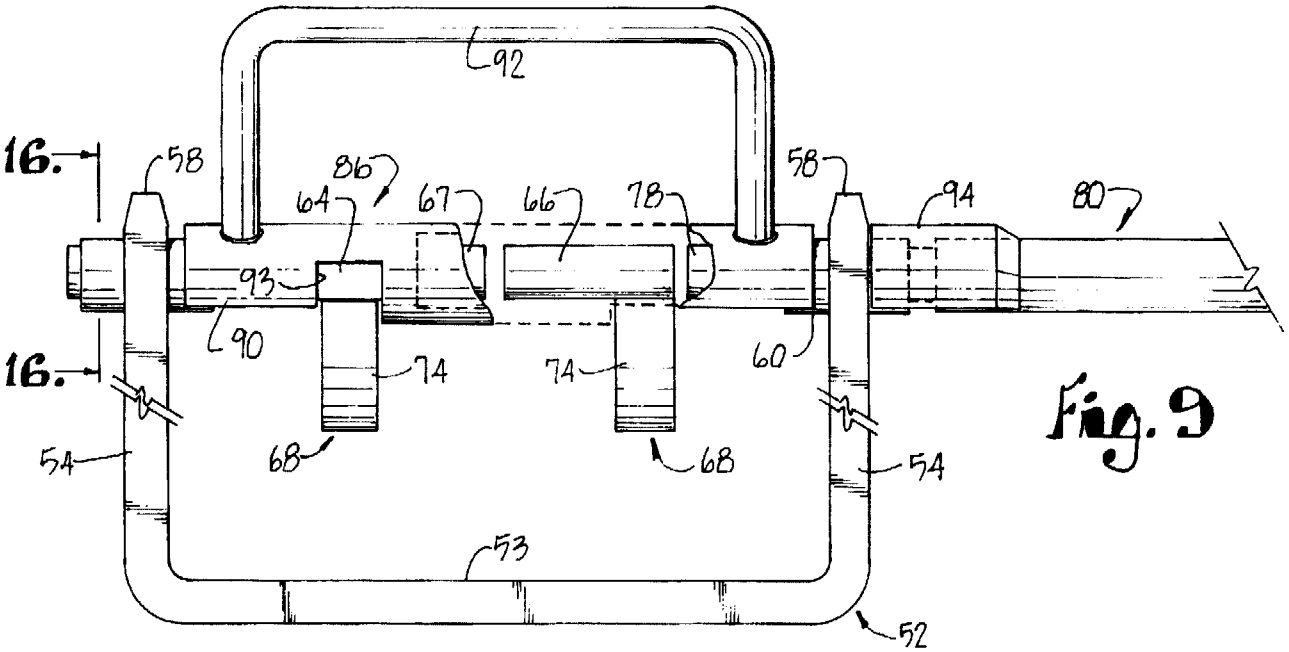
FIG. 9 is a vertical sectional view taken along line 9—9 of FIG. 7, parts being broken away to reveal details of construction.
Figure 11:
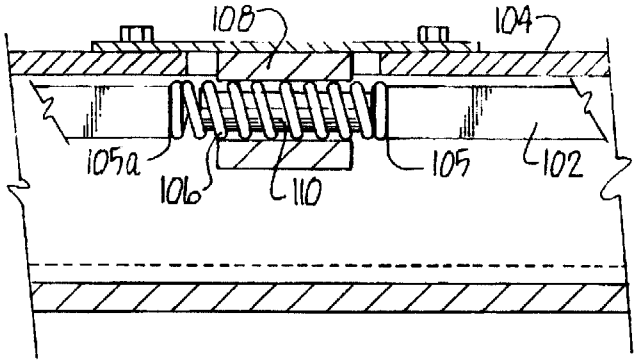
FIG. 11 is a view similar to FIG. 10 but shows the condition of the interlock mechanism when both devices are locked.

A shaft assembly 62 (FIG. 14) between the saddle elements 60 of each device 50 includes an inner sleeve or tube 64 having slotted ends which receive respective stub shafts 66 and 67, each of which is integral with a generally hook-shaped finger 68 secured to the associated hatch cover by a series of bolts 70 as seen, for example, in FIGS. 4 and 5 for the two fingers 68 secured to cover 22*a*. One end slot 72 in tube 64 is visible in the exploded view of FIG. 14. It may be appreciated that when the associated stub shaft 66 is fully inserted into slot 72, the outer end 74 of finger 68 is held in the slot 72 and thus the entire assembly 62 and the two fingers 68 are rotatable as a unit about the axis of tube 64, which is axis A or axis B of the device 50.

Figure 14:
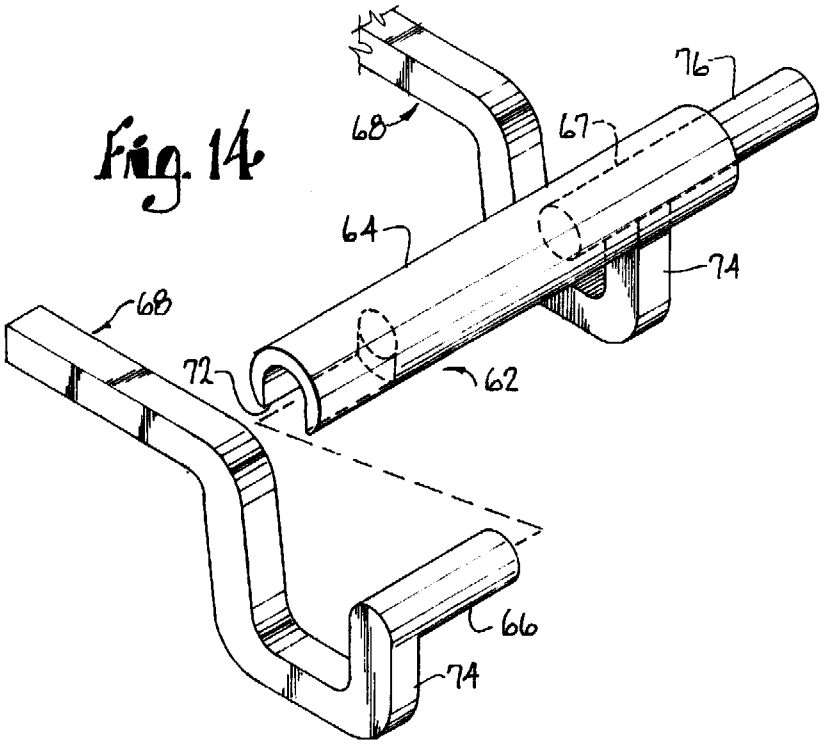
FIG. 14 is an enlarged, exploded view of the shaft assembly of the locking device.
Figure 15:
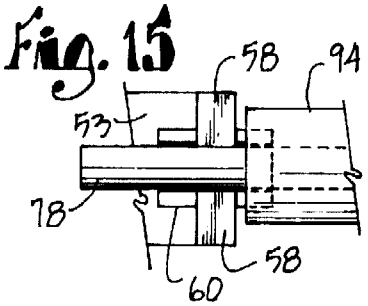
FIG. 15 is a detail in plan of the fixed saddle and the shaft it receives, looking downwardly on the right end of the mount as seen in FIG. 9.

Each of the fingers 68 may also be provided with an outwardly projecting, integral stub shaft 76 as shown at the right end of assembly 62 as viewed in FIG. 14. Shaft 76 is coaxial with stub shaft 67 and thus when finger 68 is provided with the opposed stub shafts 67 and 76, a T-shaped end configuration is formed by the opposed shafts and the outer end 74 of the finger. FIG. 14, therefore, illustrates two alternative end configurations for finger 68 depending upon the location of the device 50 on the series of hatch covers 22–22*c*. For clarify hereinafter, the finger 68 with the single stub shaft 66 will be referred to as "single-ended" and the finger 68 with opposed shafts 67 and 76 will be referred to as "double-ended."

FIGS. 4–9 show the configuration of the shaft components that present hinge axis A in device 50 as utilized in FIG. 1, with the exception of the devices 50 at the left and right ends 24 and 26 of the car 20. Tube 64 is fitted with a double-ended finger 68 and a single-ended finger 68 on the left and right, respectively, as viewed in FIGS. 4, 5 and 9. The stub shaft 76 projecting outwardly from such left finger 68 is received by the left saddle element 60 for rotation therein, and the right saddle element 60 receives a stub shaft 78 projecting axially inwardly from the end 94 of an outer connecting shaft 80 that is also aligned with axis A. In order to reveal the components, tube 64 is removed in FIG. 9 to show the stub shafts 78, 66, 67 and 76 (from right to left) that cooperate to provide a composite shaft that defines hinge axis A. As will be appreciated, connector shaft 80 serves as a hinge part for the adjacent cover 22 and is secured thereto by a pair of spaced finger members 82 attached to the stiffener bar 35 by bolts 84 or welded connections. With respect to each of the four locking devices 50 at the ends of trough 34, two double-ended fingers 68 are installed in tube 64 since covers 20 and 22c are at the ends of the series.

Figure 18:
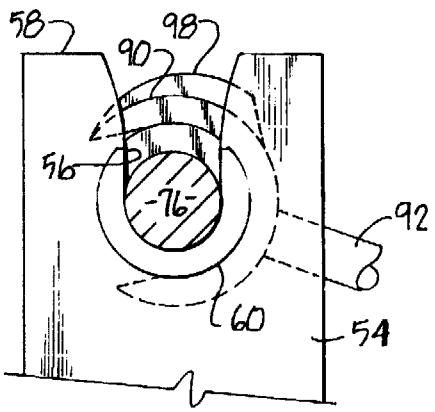
FIG. 18 is a view similar to FIG. 16 but showing the relative positions of the saddles when the device is fully locked.

A rotary locking sleeve 86, telescoped over tube 64, essentially spans the spaced legs 54 of the mount 52 and has a slot 88 in each end thereof to present a C-shaped saddle portion 90 that receives the associated saddle element 60, i.e., the part of saddle element 60 projecting axially inwardly from leg 54. As may be appreciated in FIGS. 6 and 7 and 16–18, the internal surface of the locking sleeve 86 is in contact with tube 64 and saddle elements 60 and is rotatable thereon through a limited arcuate displacement about the hinge axis (A or B) provided by shaft assembly 62 between unlocked and locking positions as will be discussed. Rotation of the locking sleeve 86 between the unlocked position thereof shown in FIGS. 7 and 16 and fully locked position shown in FIGS. 6 and 18 is accomplished manually by a handle 92 affixed to sleeve 86 that projects radially outwardly therefrom for easy access. Rotation of sleeve 86 relative to tube 64 is limited by arcuate clearance slots 93 communicating with slots 88 and aligned with respective finger ends 74.

It should be understood that the connector shafts 80 permit a single device 50 to provide a hinge for two adjacent hatch covers as may be seen, for example, in FIGS. 4 and 5 where the device 50 there illustrated defines the hinge axis A at the abutting ends of covers 22 and 22a. In order to accommodate the two-way opening action of each of the covers, the end 94 of connector shaft 80 is formed as an integral socket (FIGS. 8 and 9) concentric with stub shaft 78 and cut away at its lower wall portion 96 to present a C-shaped saddle overlying saddle element 60. The saddle thus presented by end 94 is of essentially the same transverse configuration as saddle portion 90 of sleeve 86 seen in FIGS. 16–18.

In order to prevent an undesired and hazardous condition in which the locking devices 50 on both sides of a hatch cover are unlocked, an active interlock mechanism is provided by the present invention as shown primarily in FIGS. 4–7, 10 and 11. A cam 98 centrally located on locking sleeve 86 is in engagement with the outer end 100 of an elongated interlock arm 102 which extends transversely partially across the cover through an elongated interlock housing 104. As may be appreciated from viewing FIG. 2, the housing 104 is of inverted, U-shaped configuration in transverse cross-section in order to provide a passage receiving arm 102 for longitudinal movement therein. The opposite end 105 (FIGS. 10 and 11) of arm 102 engages a coil spring 106 confined within a bore in a carrier block 108 mounted midway in housing 104. The coil 106 surrounds an axial rod 110 which is somewhat shorter in length than the normal length of coil 106 seen in FIG. 11.

Figure 10:
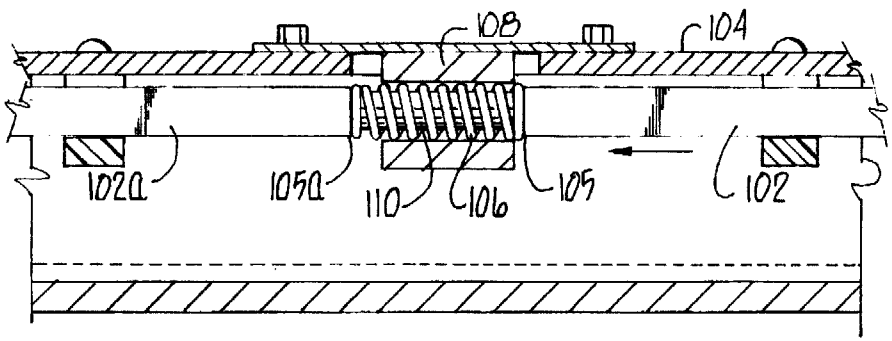
FIG. 10 is an enlarged, fragmentary, vertical sectional view through one of the hatch covers viewing the same essentially along line 3—3 of FIG. 1, showing the interlock mechanism when one of the locking devices is unlocked.

Each of the devices 50 on hinge axis B is likewise provided with the cam and actuating arm arrangement described above. For clarity, the actuating arm extending from the opposite device 50 is designated 102a in FIG. 10 and has an end 105a engaging the associated end of spring 106. Accordingly, the two devices 50 opposite each other cannot be simultaneously unlocked because, as seen in FIG. 10, the rod 110 within spring 106 fills the space between the opposed ends 105 and 105a after either of the actuating arms 102 or 102a has been shifted in response to the raising of handle 92.

Figure 13:
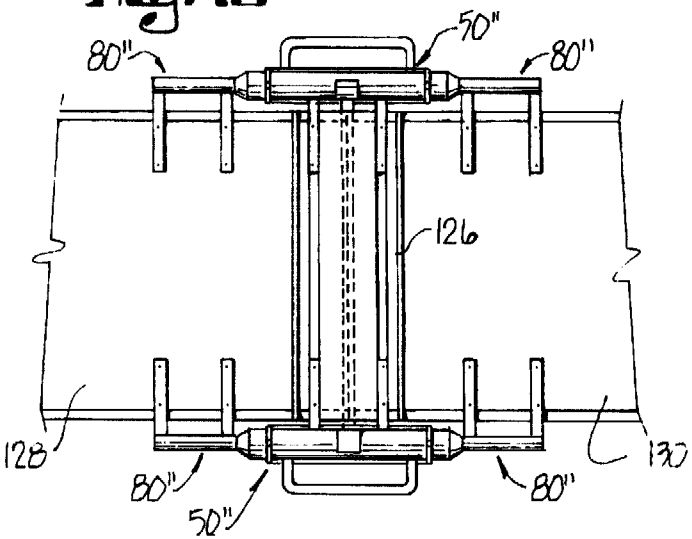
FIG. 13 is a fragmentary, plan view showing the utilization of the present invention with an alternative hatch cover arrangement where a batten bar is utilized.
Figure 12:
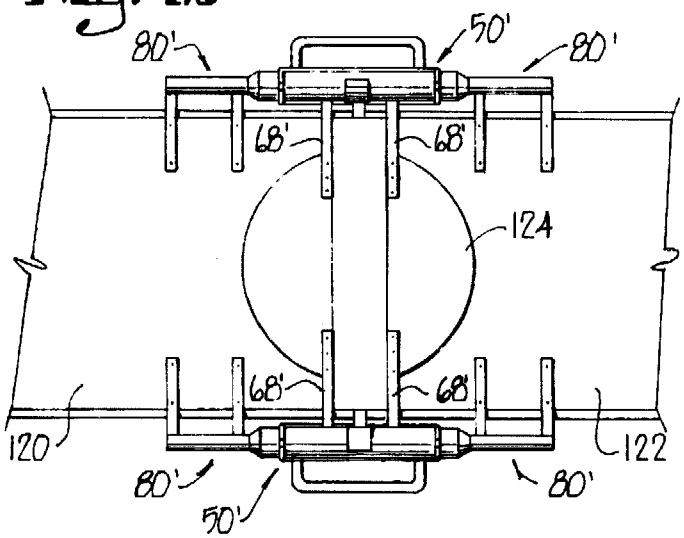
FIG. 12 is a fragmentary, plan view showing the utilization of the present invention with an alternative hatch cover arrangement where a port is provided.
Figure 16:
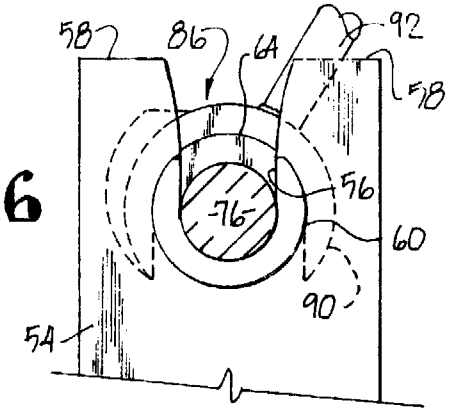
FIG. 16 is an enlarged, fragmentary, cross-sectional view taken along line 16—16 of FIG. 9, showing the relationship of the fixed and rotary saddles when the device is unlocked.

FIGS. 12 and 13 show alternative hatch cover arrangements and illustrate the manner in which the locking devices of the present invention, and associated outer connector shafts, can be adapted to other applications in which two-way cover members are employed. In FIG. 12 a hatch cover system is fragmentarily shown wherein two adjacent main covers 120 and 122 are supplemented by a smaller, circular cover 124 therebetween that overlies a circular port (not visible) between the two covers 120 and 122. Each of the two devices 50' provides both a hinge axis and a lock for the port cover 124 and employs two single ended fingers 68'. Connector shafts 80' extend from both ends of each of the devices 50' to provide the hinge axes for main covers 120 and 122. In order to open either main cover 120 or 122, the port cover 124 is first swung to an open position. The arrangement in FIG. 13 is similar except for the utilization of a cover member in the form of a batten bar 126 over the abutting ends of two adjacent hatch covers 128 and 130. The two locking devices 50" and associated connector shafts 80" are employed in the same manner as FIG. 12. The batten bar 126 must be released and rotated about one of the hinge axes before either of the covers 128 or 130 can be opened.

A typical operation will now be discussed with respect to the hopper car 20 shown in FIG. 1. It will be assumed that all of the hatch covers 22–22c are initially closed and secured by their locking devices 50. Unlocking and opening of the hatch covers begins with the right end cover 22c, this being accomplished as illustrated by releasing the two locking devices on axis B and swinging cover 22c about axis A to the open position illustrated in full lines. Alternatively, of course, the two hinge devices 50 for cover 22c on axis A could be released, and the cover 22c swung about axis B to the open position thereof shown in broken lines. As the operation is identical, it will be assumed for purposes of this discussion that the devices 50 on axis A are to be released and all of the hatch covers opened to positions resting on running board 30.

In the opening of each cover, the operation of the associated locking device or devices 50 is the same and is shown in FIGS. 4–9 and 16–18. When locked, each of the saddle portions 90 of locking sleeve 86 is in the position shown in FIGS. 6, 8 and 18 where stub shafts 76 and 78 are held in respective saddle elements 60 and cannot escape therefrom via the upwardly extending openings 56 between the pairs of ears 58. Upon rotation of handle 92, and hence sleeve 86, to the unlocked position shown in FIGS. 7, 9 and 16, each of the saddle portions 90 now registers with the associated opening 56 to permit stub shaft 76 to escape upwardly through opening 56 to thereby separate sleeve 86 and shaft assembly 62 (FIG. 14) from the fixed locking parts presented by the saddle elements 60. Accordingly, the associated cover is released from axis A and may be swung to an open position about axis B. This opening operation continues in sequence for covers 22b, 22a and 22, thereby opening the entire trough 34. Closing is accomplished in the reverse sequence. It may be appreciated, therefore, that except for one of the end covers (cover 22c in FIG. 1), only one combination hinge and locking device 50 is required for each hinge axis of an individual cover.

It should be noted that stub shaft 78 extending from connector shaft 80 remains in the associated saddle element 60 until the next cover in the sequence is opened. There is no interference with the separation of the other lock components from the saddle elements 60 due to the slots 72 in the ends of tube 64 (see FIG. 14).

Figure 17:
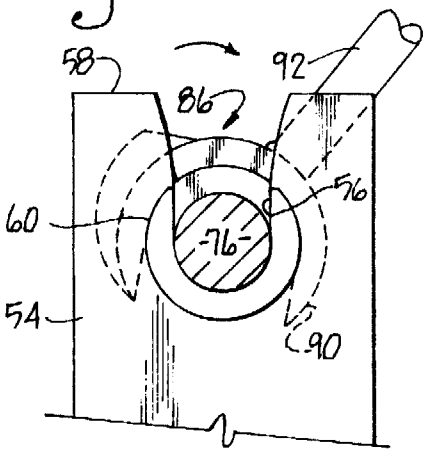
FIG. 17 is a view similar to FIG. 16 but showing the rotary saddle slightly displaced and the passive safety lock thus provided.

There may be instances in which separation of the cover from its mounts should be precluded even though the associated locking device or devices 50 have been unlocked. For example, if the device 50 on axis A associated with cover 22a is unlocked (FIG. 16), and the device 50 on the other side of cover 22a is also unlocked and the handle 92 raised to open the cover, the present invention provides a passive safety lock to prevent total separation of cover 22a from its mounts. As seen in FIG. 17, slight rotation of locking sleeve 86 in a clockwise direction (as indicated by the arrow) moves saddle portion 90 out of register with opening 56 so that the saddles 60 and 90 will interengage, i.e., provide interference precluding movement of the sleeve 86 and associated components upwardly so they are forced to remain on the hinge axis. Comparing FIGS. 6 and 7, it may be seen that this rotation of sleeve 86 is accomplished by movement of surface 112 into engagement with the corresponding outer end 74 of finger 68 when locking sleeve 86 is moved to its unlocked position (FIG. 7). Two such surfaces 112 are provided by the slots 88 in sleeve 86 as may be seen in FIG. 8, it being observed that the slots 88 are somewhat narrower in width along their inner end portions where the surfaces 112 are movable into engagement with finger ends 74. Therefore, when locking sleeve 86 is in its unlocked position, the sleeve 86 is effectively coupled with the cover 22a and rotates with the fingers 68, their associated stub shafts and tube 64 as the cover is opened. Accordingly, any attempt to swing one of the covers about the axis of an unlocked device 50 causes the action of the passive lock to immediately prevent separation from the mount 52.

Having thus described the invention, what is claimed as new and desired to be secured by Letters Patent is as follows:

1. A double hinge locking system for a two-way opening cover member, said system comprising:

a first means for providing a first hinge axis for said cover member, and a second means spaced therefrom for providing a second hinge axis for said cover member generally parallel with said first axis, said first means including a rotatable shaft defining said first axis, means for securing said shaft to said cover member, a saddle element receiving said shaft for rotation therein about said first axis and presenting an opening permitting escape of the shaft from the saddle element in a radial direction when said cover member is swung about said second axis, and a rotary locking sleeve on said shaft coaxial therewith and rotatable about said first axis between a locked position and an unlocked position, said sleeve having a saddle portion receiving said saddle element and registering with said opening when the sleeve is in its unlocked position, whereby in said unlocked position the sleeve and shaft can be separated from the saddle element and the cover member swung open about said second axis, said saddle portion rotating to an angular disposition capturing said saddle element when the sleeve is in its locked position, whereby to retain the shaft in the saddle element to confine movement of the cover member to rotation about said first axis.

2. The locking system as claimed in claim 1, wherein when said locking sleeve is in its unlocked position and said saddle portion thereof then moves out of register with said opening in response to rotation of the cover member about said first axis, the saddle element and saddle portion interengage to provide a passive safety lock preventing escape of the shaft from the saddle element.

3. The locking system as claimed in claim 2, wherein said shaft has means engaging said sleeve when the sleeve is in its unlocked position for causing the sleeve to rotate about said first axis in response to rotation of the cover member about said first axis.

4. The locking system as claimed in claim 1, further comprising a pair of said saddle elements spaced from each other for receiving said shaft, said sleeve having a pair of slotted end portions presenting a pair of said saddle portions for receiving corresponding saddle elements.

5. The locking system as claimed in claim 4, further comprising an outer connector and means for securing said connector to an adjacent two-way opening cover member, said connector having a hinge part for alignment with said first axis and provided with a saddle-shaped end for receiving one of said saddle elements to permit rotation of said hinge part thereon about said first axis and, alternatively, separation of said hinge part therefrom, whereby said one saddle element also hingedly supports the adjacent cover member.

6. A double hinge locking system for a two-way opening cover member, said system comprising:

a first means for providing a first hinge axis for said cover member, and a second means spaced therefrom for providing a second hinge axis for said cover member generally parallel with said first axis, said first means including a rotatable shaft defining said first axis, means for securing said shaft to said cover member, a saddle element receiving said shaft for rotation therein about said first axis and presenting an opening permitting escape of the shaft from the saddle element in a radial direction when said cover member is swung about said second axis, and a rotary locking part on said shaft coaxial therewith and having a saddle portion receiving said saddle element and registering with said opening when the cover member is closed, whereby the locking part and shaft can be separated from the saddle element and the cover member swung open about said second axis, said locking part being coupled with said shaft for rotation therewith and movement of said saddle portion out of register with said opening in response to rotation of the cover member about said first axis, the saddle element and saddle portion interengaging to provide a passive safety lock preventing escape of the shaft from the saddle element.

7. A double hinge locking system for a two-way opening cover member, said system comprising:

a first means for providing a first hinge axis for said cover member, and a second means spaced therefrom for providing a second hinge axis for said cover member generally parallel with said first axis, said first means including a first locking device having a rotatable shaft defining said first axis, said second means including a second locking device having a rotatable shaft defining said second axis, and each of said locking devices including means for securing said shaft thereof to said cover member, a fixed locking part receiving said shaft for rotation about its axis, and a rotary locking part coaxial with said shaft and rotatable about the axis thereof between a locked position maintaining the shaft in said fixed part so that the cover member can be swung open upon release of the other locking device, and an unlocked position permitting separation of the shaft from the fixed part so that the cover member can be swung open about the hinge axis provided by the other locking device.

8. The locking system as claimed in claim 7, wherein in each of said locking devices, said rotary locking part in its unlocked position is coupled with said shaft for rotation therewith to a safety lock position preventing separation of the shaft from the fixed part if the cover member is swung about the hinge axis of an unlocked device.

9. The locking system as claimed in claim 7, further comprising interlock means responsive to the rotary locking part of each of said locking devices for preventing rotation of the rotary part of one of said devices to its unlocked position when the rotary part of the other device is in its unlocked position.

10. A double hinge locking system for a two-way opening cover member, said system comprising:

a first means for providing a first hinge axis for said cover member, and a second means spaced therefrom for providing a second hinge axis for said cover member generally parallel with said first axis, said first means including a first locking device having a rotatable shaft defining said first axis, said second means including a second locking device having a rotatable shaft defining said second axis, and each of said locking devices including means for securing said shaft thereof to said cover member, a saddle element receiving said shaft for rotation therein about its axis and presenting an opening permitting escape of the shaft from the saddle element in a radial direction when said cover member is swung about the hinge axis provided by the other locking device, and a rotary locking sleeve on said shaft coaxial therewith and rotatable about the axis of the shaft between a locked position and an unlocked position, said sleeve having a saddle portion receiving said saddle element and registering with said opening when the sleeve is in its unlocked position, whereby the sleeve and shaft can be separated from the saddle element and the cover member swung open about the hinge axis provided by the other locking device, said saddle portion rotating to an angular disposition capturing said saddle element when the sleeve is in its locked position, whereby to retain the shaft in the saddle element to provide the hinge axis for opening the cover member upon release of the other locking device.

11. The locking system as claimed in claim 10, wherein in each of said locking devices when the sleeve thereof is in its unlocked position, said saddle portion moves out of register with said opening upon rotation of said shaft, whereby the saddles interengage to provide a passive safety lock preventing escape of the shaft from the saddle element if the cover member is swung about the hinge axis of an unlocked device.

12. The locking system as claimed in claim 10, further comprising interlock means responsive to the rotary locking sleeve of each of said locking devices for preventing rotation of the sleeve of one of said devices to its unlocked position when the sleeve of the other device is in its unlocked position.

13. The locking system as claimed in claim 12, wherein said interlock means includes a pair of movable actuating arms between said first and second axes each having an end adjacent the locking sleeve of a corresponding locking device, a cam on each sleeve engageable with the end of the corresponding arm to shift the arm to an actuated position upon rotation of the sleeve to its unlocked position, and means between the arms limiting movement of one of the arms when the other arm is shifted to its actuated position, whereby to prevent simultaneous unlocking of both locking devices.

* * * * *